United States Patent [19]

Kelly

[11] 4,114,934

[45] Sep. 19, 1978

[54] HANDLE FOR SLIDING WINDOW

[76] Inventor: Donald V. Kelly, 15903 Candor Ridge Rd., Canyon Country, Calif. 91351

[21] Appl. No.: 679,798

[22] Filed: Apr. 23, 1976

Related U.S. Application Data

[62] Division of Ser. No. 513,296, Oct. 9, 1974, Pat. No. 4,004,629.

[51] Int. Cl.[2] ..... E05C 3/04

[52] U.S. Cl. ..... 292/87; 292/DIG. 38; 49/460; 16/124

[58] Field of Search ..... 16/124, 114 R, 110 R, 16/15; 294/27 R, 27 H; 49/460, 449; 292/DIG. 30, DIG. 38, 80, 87, 88, 89

[56] References Cited

U.S. PATENT DOCUMENTS

| | | | |
|---|---|---|---|
| 1,491,045 | 4/1924 | Johnson | 294/27 R X |
| 2,947,559 | 8/1960 | Olsson | 292/DIG. 30 |
| 3,050,322 | 8/1962 | Miller | 49/449 X |
| 3,078,524 | 2/1963 | Minick | 49/449 |
| 3,107,389 | 10/1963 | Engelbrecht | 16/124 |
| 3,161,923 | 12/1964 | Crain | 49/449 X |
| 3,212,123 | 10/1965 | Southcott et al. | 294/27 R X |
| 3,514,904 | 6/1970 | Riegelman | 49/460 |
| 3,544,146 | 12/1970 | Asenbauer | 292/87 |
| 3,822,905 | 7/1974 | Bell | 292/87 |
| 3,881,758 | 5/1975 | Gross | 292/87 |
| 3,893,261 | 7/1975 | Cribben | 49/449 |

*Primary Examiner*—Andrew V. Kundrat
*Attorney, Agent, or Firm*—John E. Wagner

[57] ABSTRACT

A novel handle for use in sliding windows and the like formed as a single member and providing the functions of a handle, a catch and a resilient spring release portion which is formed integrally with the handle. The handle includes a surface which may be bonded to the surface of a window light or door by an adhesive while still providing the necessary functions of a gripping handle, a catch and a spring catch releasing mechanism.

3 Claims, 6 Drawing Figures

HANDLE FOR SLIDING WINDOW

This is a division of application Ser. No. 513,296 filed Oct. 9, 1974 now U.S. Pat. No. 4,004,629.

BACKGROUND OF THE INVENTION

Horizontal sliding windows have been well accepted in the residential, commercial and mobile home fields for a number of years. They have been favored architecturally, tending to give a long low line to the structure. They do not require complex mechanism for opening and closing as in the case of gear operated casement windows or counter balanced double hung windows. The weight of the moving window or windows is supported totally by the structure and the user need only exert sufficient force to overcome the sliding friction to open or close the window.

Typically, horizontal sliding windows are fashioned generally as horizontal versions of a double hung window having a frame about each pane of glass and a stile portion. Each of these add to the weight and cost of the window and serve to reduce the overall available window space by placing an undesirable interfering mullion at the center of the window or multiple interfering mullions when the window is partially open.

BRIEF STATEMENT OF THE INVENTION

Faced with the foregoing, I have developed a frameless sliding window assembly employing only two simple extruded shapes which define all four sides of the window casement and totally eliminate window frames per se. No mullion is present and a simple novel handle and integral latch secures the window when in closed position.

BRIEF DESCRIPTION OF THE DRAWINGS

This invention may be more clearly understood from the following detailed description and by reference to the drawings in which.

DETAILED DESCRIPTION OF THE INVENTION

Figure 1:
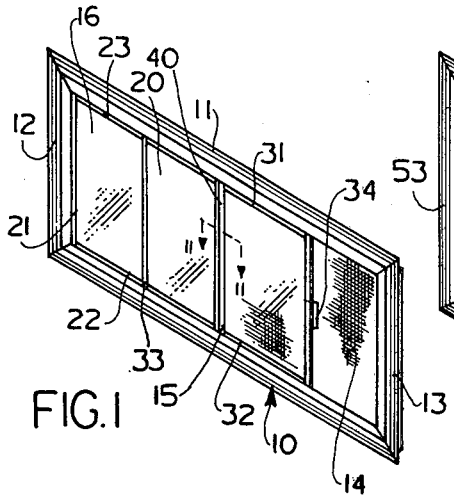
FIG. 1 is a perspective view of a horizontal sliding metal frame window in accordance with the prior art.

Now referring to FIG. 1, a typical metal framed window according to the prior art is shown including a metal sill 10, a header 11, jambs 12 and 13 which typically are fabricated from extruded aluminum alloy. Each member, 10–13 includes an edge lip and a casement section which engage the outside wall and framed opening respectively in the structure where installed. Typically, a window of this nature opens at one side and has a half screen 14 with its screen frame 15, one side of which appears in FIG. 1. There is one fixed pane or lite 16 and a movable lite 20. The lite 16 is often separately framed as represented by frame members 21, 22, 23 and 24. The movable lite 20 likewise has four frame members 30, 31, 32 and 33. Various types of closure handles and locks have been devised for such windows. A particularly useful handle and lock is shown in my U.S. Pat. No. 3,813,130, issued May 28, 1974.

In certain cases of the prior art, the fixed lite 16 is secured directly to the frame and therefore the frame members 21 through 23 are not necessarily present. However, the frame members 30, 31, 32 and 33 of the movable window are present.

Figure 2:
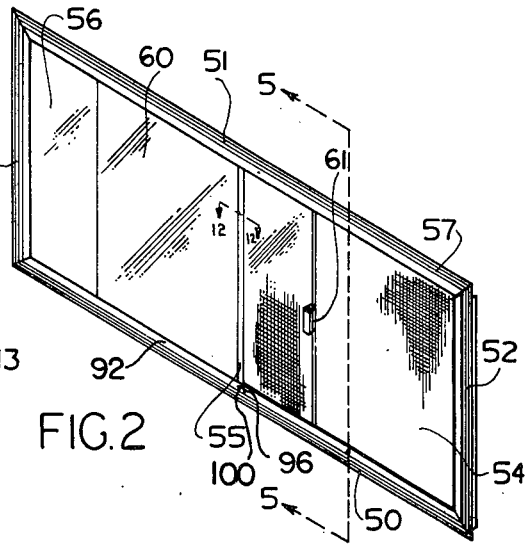
FIG. 2 is a perspective view of a horizontal sliding window in accordance with this invention.

In accordance with my invention, I have simplified the design of a simple metal frame window as illustrated in FIG. 2. Again, it employs a sill 50, header 51, jambs 52 and 53 and a half screen 54. The screen 54 is secured in its own frame, one member of which 55 appears in FIG. 2. A fixed lite 56 appears in the drawing of that side of FIG. 2, and a partially opened movable lite 60 appears in FIG. 2. The lite 60 is preferably of tempered or safety glass and has ground edges on all four sides, the upper and lower to facilitate sliding movement in the frame and to prevent injury to one coming in contact with the window edge. The movable lite 60 has secured to its inner side a novel handle 61 in accordance with this invention which engages the jamb 52 in a manner as best illustrated in FIG. 10. FIGS. 1 and 2 clearly illustrate a principal feature of this invention. You will note by comparison of FIG. 2 with FIG. 1 that in FIG. 2 the relative viewing areas are greater because of the elimination of all frames around the window lites.

Figure 3:
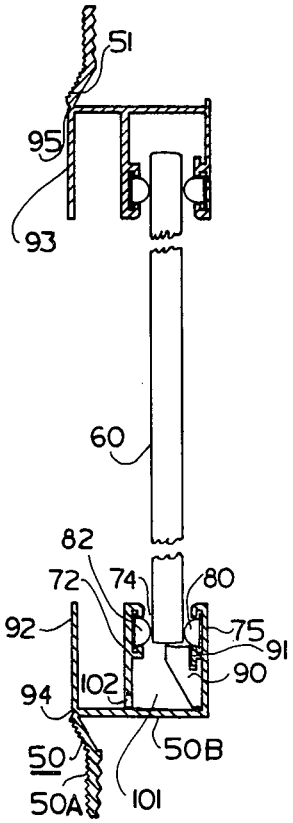
FIG. 3 is a vertical section along line 5—5 of FIG. 2.

The details of the window assembly and the relative position of parts are best seen from an examination of FIG. 2 in conjunction with FIG. 3 of the drawings. FIG. 3 is a vertical section to the assembly of FIG. 2 with the screen removed. The sill 50 includes a tapered lower flange portion 50A which engages the outer surface of the structure to which the window is attached while the surface 50B; shown in FIG. 3, constitutes the casement portion and rests on the framing of the structure as indicated above. The portion 50A forms a right angle corner with a similar lip 52B of the jamb 52. These two frame members define a corner recess for the screen frame made up of members 70 and 71 and screen proper 54. Note that in this corner which is the lower right hand corner of assembly of FIG. 2, there are no retainers for the screen. As will be seen later, this is unnecessary. The screen members 70 and 71 overlie respective longitudinal external ribs 72 and 73 which define the lower front face and side face of the window groove 74 appearing in FIG. 3. A matching inner or rear rib 75 defines the longitudinal window retaining recess which appears in FIG. 6. It should also be noted in FIG. 3 that a pair of seals 80 and 81 are positioned adjacent to the lite 60 in captive grooves integral with the ribs 75 and 76. Similar seals such as seal 82 appearing in FIG. 3 are held in captive arrangement within the front rib 72. Other seals appear around the periphery of the moving lite 60. It should be noted by reference to FIG. 3 that the header 51 and the sill 50 are identical sections. The only difference between the two which is apparent is that the sill 50 contains a plastic support rib 90 positioned in one corner and captured by a T shaped tang 91 integral with the rear wall 75. The header 51 has the same T shaped tang but no support member 90. One other difference between the sections 50 and 51 is that the front rib 92 of the member 50 is discontinuous as in contrast from its matching member 93 of the header 51. A notch 94 is apparent at the base of the rib 92 and a similar notch 95 appears at the base of rib 93. This notch is instrumental in allowing the selective removal of portions of the rib 92 in a manner which allows the insertion and locking of the screen 54 in place. This feature is apparent in FIG. 2 which shows the front rib 92 which terminates at an angular end 96 with the portion to the right of the angular portion 96 having been removed by severing along the line 96 and breaking the section of the rib 92 at its notch 94. Similarly, as is apparent in FIG. 2, the front rib is absent from the member 52. Given this arrangement, the screen 54, including its frame members 55, 70 and 71 as appearing in FIG. 2, and the upper frame member unshown in the drawing may be inserted and removed by removal of the locking screw 100 appearing in FIG. 4 and by slightly bending the frame of the screen and sliding it to the right and outward in the drawing of FIG. 2. When in place, the screen is held securely by the front rib of the header 51, the section of front rib 92 extending to the right of frame 55 and the screw 100. Of course, additional fastening means may be used if desired but I have found that the arrangement described and shown above more than adequately secures the screen in place. In as much as the total amount of metal in the window assembly has been reduced, I have been able to employ better quality screen frame members, extruded rather than rolled, which actually adds to the overall strength and utility and attractive appearance of the assembly.

Figure 4:
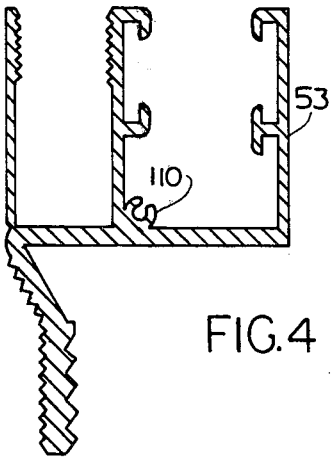
FIG. 4 is an enlarged detail of the sill in accordance with this invention.
Figure 5:
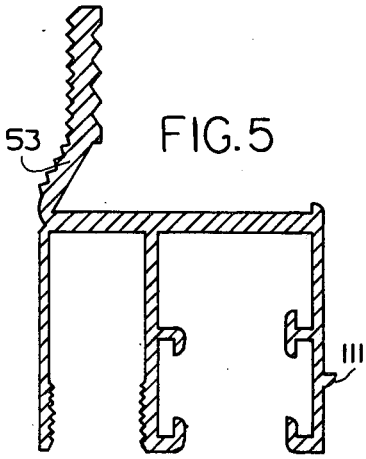
FIG. 5 is an enlarged end view of the jamb section of this invention.

Another feature of the invention is apparent by reference to FIGS. 4 and 5 which show the cross section of the jambs 52 and 53 respectively, which may be seen are substantially identical. The only additional features from the extrusions 50 and 51 of FIG. 3 are the screw locking ribs 110 of FIG. 5 and the locking rib 111 of FIG. 4. The screw locking screw 110 of FIG. 5 is used in a manner that is well known in the extrusion field. This screw may be eliminated if other forms of corner fastening are employed. The locking rib 111 of FIG. 4 forms an attractive edge detail and may be added to the extrusion form of FIG. 5 and in actuality may be present on all edges. In such case, all window frame extrusions may be identical thereby reducing the cost of windows in accordance with this invention even further.

Figure 6:
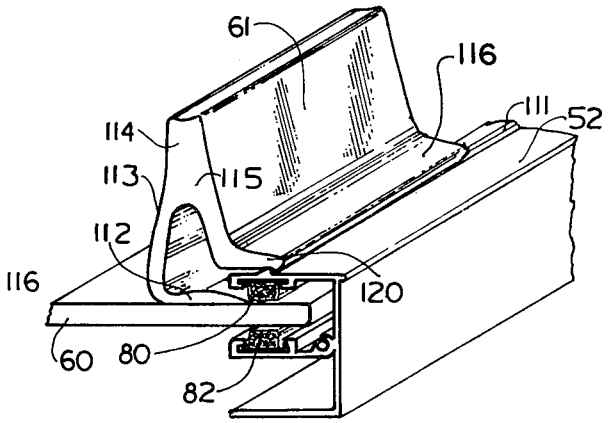
FIG. 6 is a perspective view of the handle locking member of this invention.

The presence of edge rib 111 as shown in FIG. 5 forms a significant part of this invention in that it cooperates with the novel handle design as shown in FIG. 6 to secure the window in a closed position to perpetuate a seal and lock the window. This novel arrangement is best seen in FIG. 6. There, the jamb 52 with its integral rib 111 is shown with the lite 60 in a closed position with a foot portion 112 extending between seal 80 and lite 60. The handle 61 appears as a unitary member having a degree of flexibility and having foot portion 112 which is secured to the inner surface of the lite 60 by cement or other means. This foot 112 is connected by a distortable leg portion 113 connected to the main body or hand grip portion 114. This hand grip or body portion includes a second leg 115 terminating in a second foot 116 having a toe or catch 120 positioned to engage the rib 111. The leg 115 and foot 116 are shown of greater thickness than the leg 112 or 113. Given this arrangement, more of the flexibility appears in the leg 113 although this is not necessarily restrictive since both legs 113 and 115 may flex or the major amount of flexibility may be in leg 115. In any event, the foot 112 includes a tapered front surface which rides between the seal 80 and the pane or lite 60 to apply pressure against the lite 60 at its innerface thereby applying a gentle bias force against the lite and in turn against the front or weather seal. The foot 116 rests over the rib 111 in locking arrangement. Locking is effective, being over a distance in the order of 2 to three inches and when locked, the window is relatively safe from intrusion by wedging or other similar means to open it. When locked, also the window is relatively well sealed by the pressure applied by the handle. Opening of the window is accomplished simply by grasping the handle or body portion 114 and flexing the handle in the direction of desired movement which disengages the toe 120 and allows the window to slide freely. All of this is achieved in a single unitary member.

The above described embodiments of this invention are merely descriptive of its principles and are not to be considered limiting. The scope of this invention instead shall be determined from the scope of the following claims and including their equivalents.

What is claimed is:

1. A handle for moving and locking a moving member with respect to a frame comprising;

(a) a unitary body defining (b) a handle portion;

(c) a pair of leg portions depending from said handle portion;

(d) the first of said pair of leg portions including a first foot, the underside of said first foot constituting the mounting surface of said handle on the said moving member;

(e) the second of said pair of leg portions including a second foot, said second of said pair of leg portions being spaced from said first of said pair of leg portions at least in the region of said feet;

(f) said second foot including an integral catch for engaging the said frame;

(g) said first and second feet defining a throat region for receiving said frame;

(h) at least one of said leg portions being distortable to allow the engagement and disengagement of said catch with said frame by distortion of said leg portion.

2. The combination in accordance with claim 1 wherein the surface of said first foot adjacent to said second foot is tapered to allow varying engagement with a frame entering said throat region.

3. The combination in accordance with claim 1 wherein said body is elongated and substantially uniform cross section throughout its length whereby said foot portions engage said frame over substantially the entire length of said handle.

* * * * *